US011686452B1

(12) United States Patent
Yeh et al.

(10) Patent No.: US 11,686,452 B1
(45) Date of Patent: Jun. 27, 2023

(54) HEADLIGHT FOR DEICING

(71) Applicant: MAXZONE VEHICLE LIGHTING CORP., Fontana, CA (US)

(72) Inventors: Yen-Liang Yeh, Changhua County (TW); Yan-Feng Liu, Changhua County (TW)

(73) Assignee: MAXZONE VEHICLE LIGHTING CORP., Fontana, CA (US)

( * ) Notice: Subject to any disclaimer, the term of this patent is extended or adjusted under 35 U.S.C. 154(b) by 0 days.

(21) Appl. No.: 17/891,538

(22) Filed: Aug. 19, 2022

(30) Foreign Application Priority Data

May 10, 2022 (TW) ..... 111204770

(51) Int. Cl.

| | |
|---|---|
| ***F21S 45/60*** | (2018.01) |
| ***F21S 41/40*** | (2018.01) |
| ***F21S 41/141*** | (2018.01) |
| ***F21S 41/13*** | (2018.01) |

(52) U.S. Cl.
CPC ..... *F21S 45/60* (2018.01); *F21S 41/13* (2018.01); *F21S 41/141* (2018.01); *F21S 41/40* (2018.01)

(58) Field of Classification Search
CPC ..... F21S 45/60; F21S 41/13
See application file for complete search history.

(56) References Cited

FOREIGN PATENT DOCUMENTS

DE 102011080489 A1 * 8/2012 ..... F21S 41/13

* cited by examiner

*Primary Examiner* — Sean P Gramling
(74) *Attorney, Agent, or Firm* — Muncy, Geissler, Olds & Lowe, P.C.

(57) ABSTRACT

A headlight is disclosed, comprising a headlight body, a temperature sensor, an IR module, a low beam module, and a controller. The headlight body has a housing and a lampshade. The lampshade has a light-absorbing and heating layer. The temperature sensor is configured inside the headlight body, to detect the temperature of the lamp. The IR module is a wide-angle LED lamp, positioned inside the headlight body, and It directly irradiates toward the lampshade. The low beam module is configured inside the headlight body, emitting toward the lampshade, and an emitting direction of the low beam module crosses an irradiating direction of the IR module. The controller is electrically connected to the IR module and the temperature sensor, and turns on/off the IR module based on the temperature of the lamp.

9 Claims, 5 Drawing Sheets

HEADLIGHT FOR DEICING

BACKGROUND

Technical Field

The present disclosure relates to a headlight for deicing.

Related Art

It often snows in the winter in those countries located at high latitudes or covered by high mountains. As a result of continuous snowing, snow accumulation and icing, the surface of the headlights or even the whole vehicle will be covered by snow or ice, which will block the beam of the lamp, and affect the visibility of driving.

Therefore, in areas with frequent snowing, vehicle lamps shall be installed with devices to melt the snow or ice. Currently, most such devices provide the snow-melting or deicing properties by attaching heating wires to the lampshade, using electric heating or producing heat through invisible light.

SUMMARY

The present disclosure provides a headlight for deicing, comprising a headlight body, a temperature sensor, an IR module, a low beam module and a controller. The headlight body has a housing and a lampshade. The lampshade has a light-absorbing and heating layer. The temperature sensor is configured inside the headlight body, to detect the temperature of the headlight. The IR module is a wide-angle LED lamp, positioned inside the headlight body, which directly irradiates toward the lampshade. The low beam module is configured inside the headlight body, emitting toward the lampshade, and an emitting direction of the low beam module crosses an irradiating direction of the IR module. The controller is electrically connected to the IR module and the temperature sensor, and turns on/off the IR module based on the temperature of the headlamp.

When the IR module irradiates toward the surface of the light-absorbing and heating layer of the lampshade, the invisible light is absorbed by the light-absorbing and heating layer and is converted to thermal energy to remove the moisture (fog) outside the lampshade. Even if a wide-angle LED lamp is adopted to dissipate the range of the invisible light to the whole lampshade, it can still provide good defogging and deicing properties.

Preferably, the headlight body is installed with a high beam module. The IR module is controlled to be turned on together with the low beam module or high beam module.

Preferably, the controller turns on the IR module based on a certain temperature period.

Preferably, the housing is installed with a frame to be located in front of the low beam module and the high beam module. The frame has at least two openings respectively corresponding to emitting directions of the low beam module and the high beam module. The invisible light of the IR module irradiates toward the lampshade from the opening of the low beam module.

Preferably, part of the beams of the IR module irradiates directly toward the lampshade, and the other part of the beams is reflected by the reflector of the low beam module and then toward the lampshade.

Preferably, the thickness of the aforesaid light-absorbing and heating layer is 10 μm~10 mm.

Preferably, the light-absorbing and heating layer of the lampshade is distributed with light-absorbing and heating particles. The size of the light-absorbing and heating particles is 1 nm~500 nm.

Preferably, the light-absorbing and heating layer contains 0.005 wt %~10 wt % light-absorbing and heating particles. The light-absorbing and heating particles are selected from one or more of tungsten oxide nanoparticles, tungsten bronze compound nanoparticles, indium tin Oxide (ITO), antimony tin oxide (ATO), and lanthanum hexaboride ($LaB_6$).

Preferably, the lampshade is made of a light-absorbing and heating layer.

DETAILED DESCRIPTION

Figure 1:
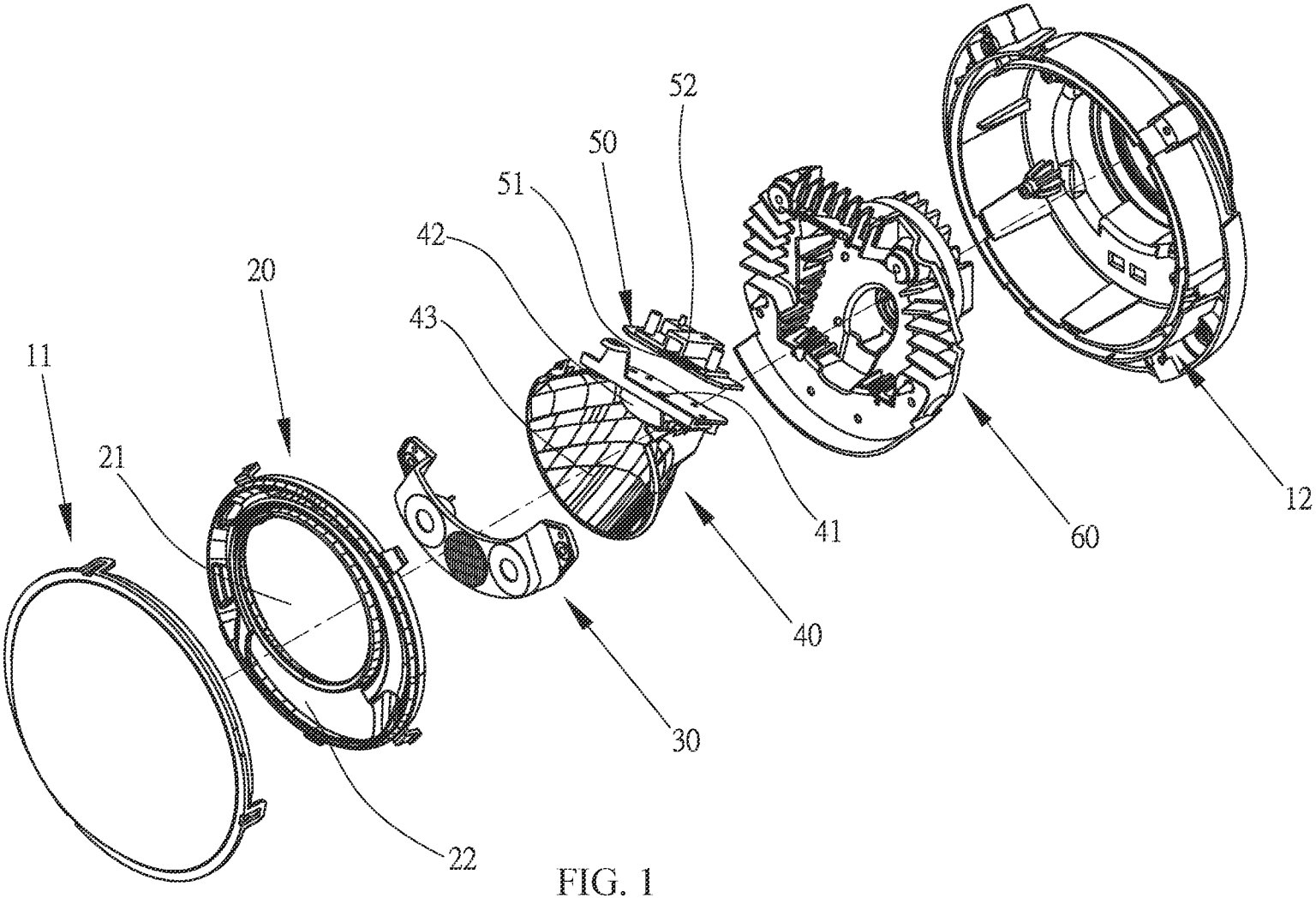
FIG. 1 is an exploded view of the components of the headlight for deicing.
Figure 2:
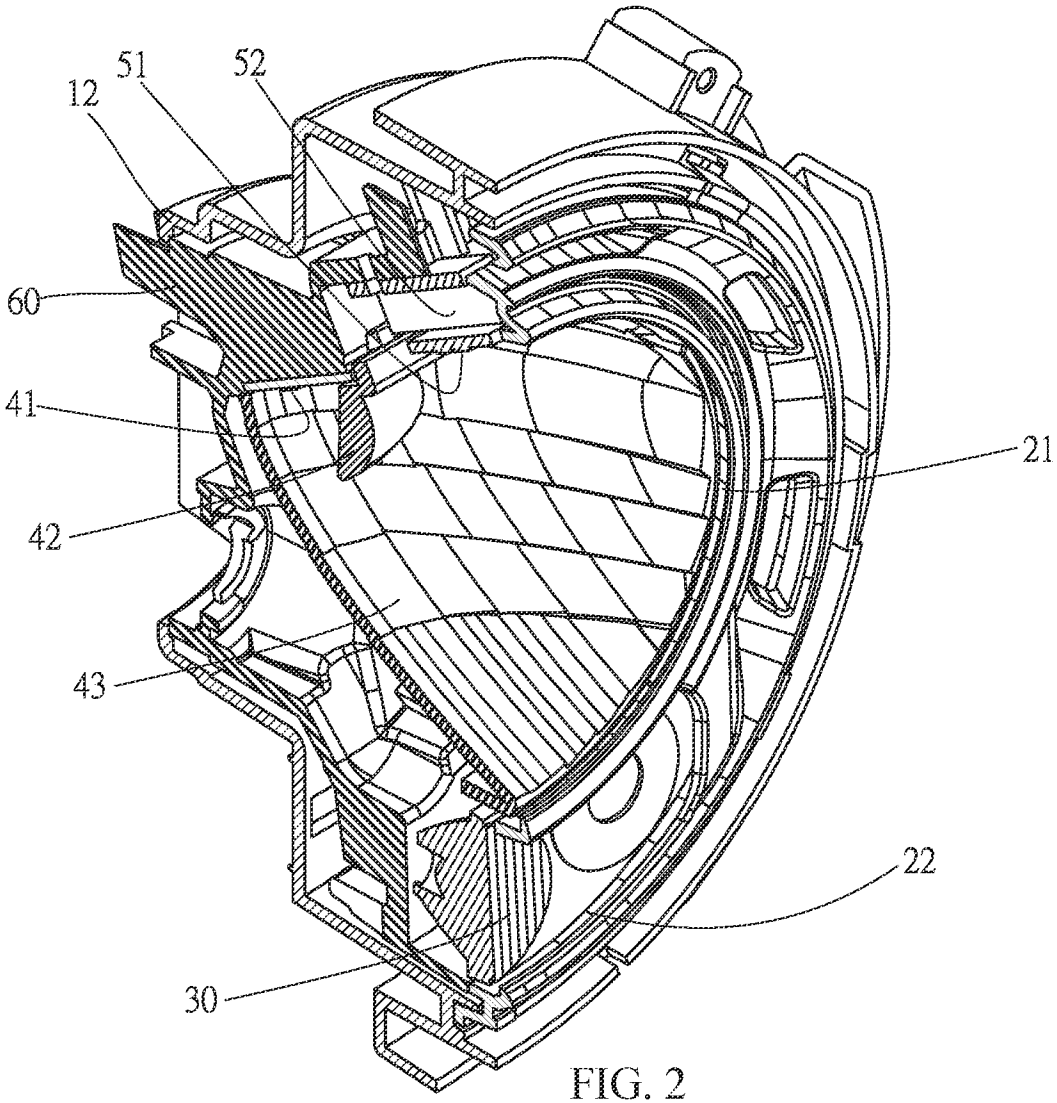
FIG. 2 is a sectional perspective view of the headlight.

For better understanding by those skilled in the art, the following descriptions are provided based on the assumption that the irradiating direction of the headlight is the front direction.

Depicted in FIG. 1 through FIG. 5 is a headlight, which comprises a headlight body 10, a frame 20, a high beam module 30, a low beam module 40, an IR module 50, and a temperature sensor 70.

The headlight body 10 has a housing 12 and a lampshade 11. The front of the housing 12 is installed with a cooling fin 60. The high beam module 30, the low beam module 40, and the IR module 50 are installed with the cooling fin 60, and are located behind the lampshade 11.

The housing 12 is installed with a frame 20 located in front of the high beam module 30, the low beam module 40, and the IR module 50. In the direction indicated in FIG. 3, the frame 20 has an upper opening 21 and a lower opening 22, respectively corresponding to an emitting directions of the low beam module 40 and the high beam module 30.

The emitting directions of the high beam module 30 and the low beam module 40 are both toward the front side. The irradiating direction of the IR module 50 crosses the emitting direction of the low beam module 40. The invisible light of the IR module 50 directly irradiates the lampshade 11 from the opening 21 on the frame 20 which corresponds to the low beam module 40. Here, "directly" means that the light path of part of the invisible light beams of the IR module 50 toward the lampshade 11 does not pass any reflecting surface, deflecting surface, or optical element.

In the present embodiment, the IR module 50 comprises a wide-angle LED lamp 51 and a base 52. The base 52 is used for installation of the wide-angle LED lamp 51. The base 52 is then installed on the cooling fin 60, so that the wide-angle LED lamp 51 is tilted downward and irradiates on the back side of the lampshade 11. The irradiating range of the wide-angle LED lamp 51 can cover the lampshade 11 in front of the high beam module 30 and low beam module 40. The irradiating angle of the wide-angle LED lamp 51 can range from 100 degrees to 150 degrees. Preferably, the irradiating angle is 120 degrees. Alternatively, the irradiating range of the wide-angle LED lamp 51 can be more than 70% or 80% of the rear surface of the lampshade 11.

The lampshade 11 has a light-absorbing and heating layer 111. In the present embodiment, the light-absorbing and heating particles are mixed with the plastic particles and are formed into the lampshade 11 through injection molding. Therefore, the lampshade 11 is made of the light-absorbing and heating layer 111. In another embodiment, the light-absorbing and heating layer 111 can be a film structure adhered to or coated on the surface of the lampshade 11. There is no limitation on the constitution of the light-absorbing and heating layer 111.

The light-absorbing and heating layer 111 has a thickness of 10 μm~10 mm, and contains 0.005 wt %~10 wt % of light-absorbing and heating particles. The size of the light-absorbing and heating particles is 1 nm~500 nm. The above light-absorbing and heating particles are selected from one or more tungsten oxide nanoparticles, tungsten bronze compound nanoparticles, indium tin oxide, antimony tin oxide, and lanthanum hexaboride.

The temperature sensor 70 can be configured on the inside or outside of the headlight body 10, to detect the headlight temperature 701.

The controller 80 is at least electrically connected to the IR module 50 and the temperature sensor 70, and controls the on/off modes of the IR module 50 based on the headlight temperature 701. Specifically, the controller 80 activates the IR module 50 based on a temperature period 801. Here, the temperature period 801 is in a range of −10 degrees to 30 degrees. When the headlight temperature 701 is in a range of −10 degrees to 15 degrees, the controller 80 starts the IR module 50, to heat up the lampshade 11 to melt the moisture, snow or ice accumulated on the lampshade 11; when the headlight temperature 701 is higher than or equal to 30 degrees, the controller 80 turns off the IR module 50, to avoid damage of the vehicle lamp due to excessive temperature difference or overheat.

Alternatively, the temperature sensor 70 can be configured on the inside and outside of the headlight body 10 respectively, and the activation of the IR module 50 is determined by the temperature difference between the inside and outside of the headlight body 10.

When the IR module 50 is activated, the IR module 50 irradiates toward the light-absorbing and heating layer 111 of the lampshade 11. The light absorbed by the light-absorbing and heating layer 111 is converted to thermal energy, which can remove the moisture (fog) or snow outside the lampshade. Even if the wide-angle LED lamp 51 is adopted to dissipate the irradiating range to the whole lampshade 11, a good defogging property can be maintained. In addition, the area on the lampshade 11 not irradiated by the wide-angle LED lamp 51 can also help convert the optical energy into thermal energy through the light-absorbing and heating layer 111, so as to remove the moisture (fog) or snow in this area.

The range of wave length of the wide-angle LED lamp 51 can be 800 nm~950 nm. For the light-absorbing and heating layer 111, a wave length within the above range can offer efficient energy conversion.

As the IR module 50 will not directly affect the emitting range of the high beam module 30 and the low beam module 40, the IR module 50 can be controlled by the controller 80 to be activated together with the low beam module 40 or the high beam module 30.

Figure 3:
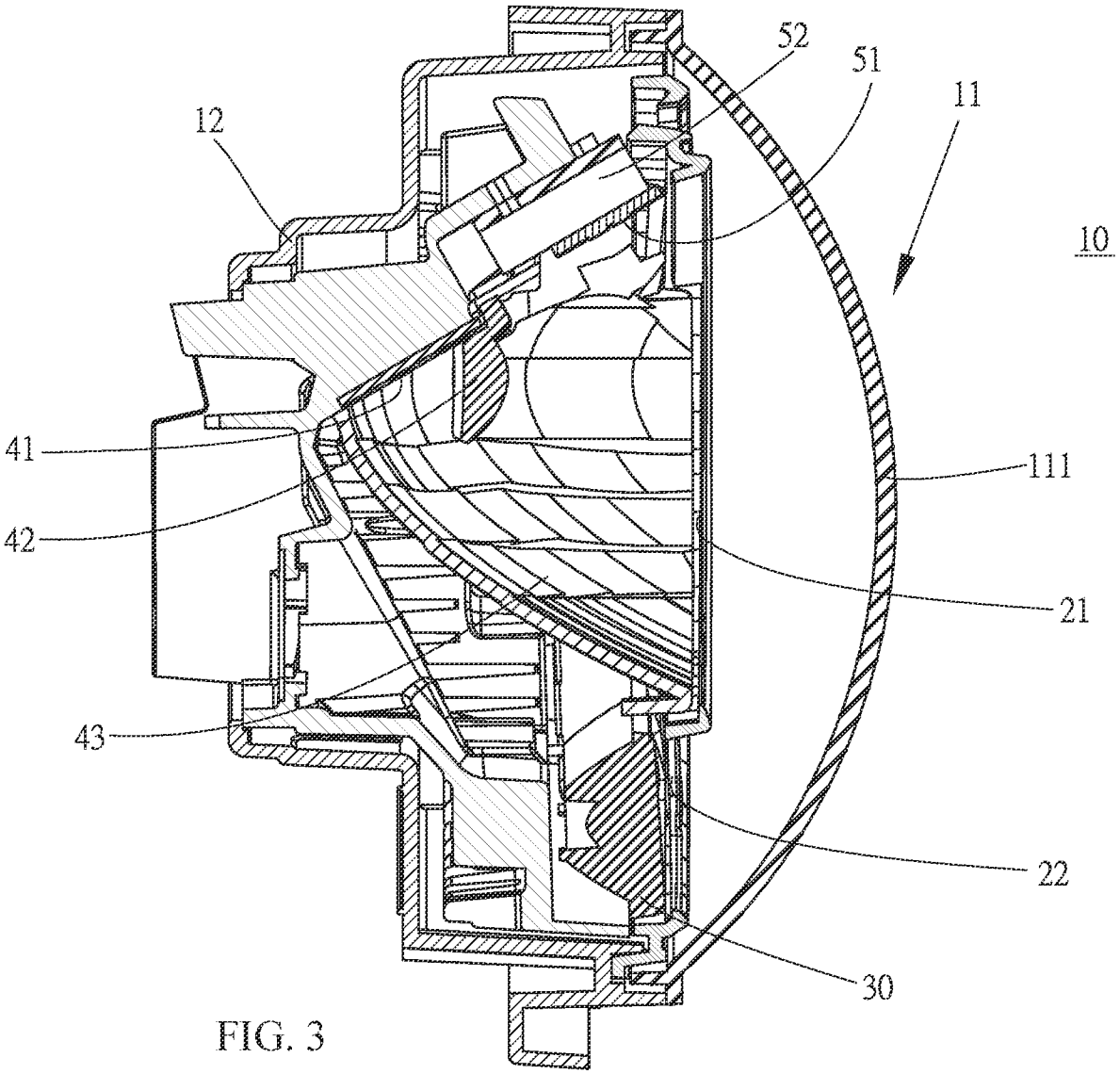
FIG. 3 is a sectional view of the headlight.
Figure 4:
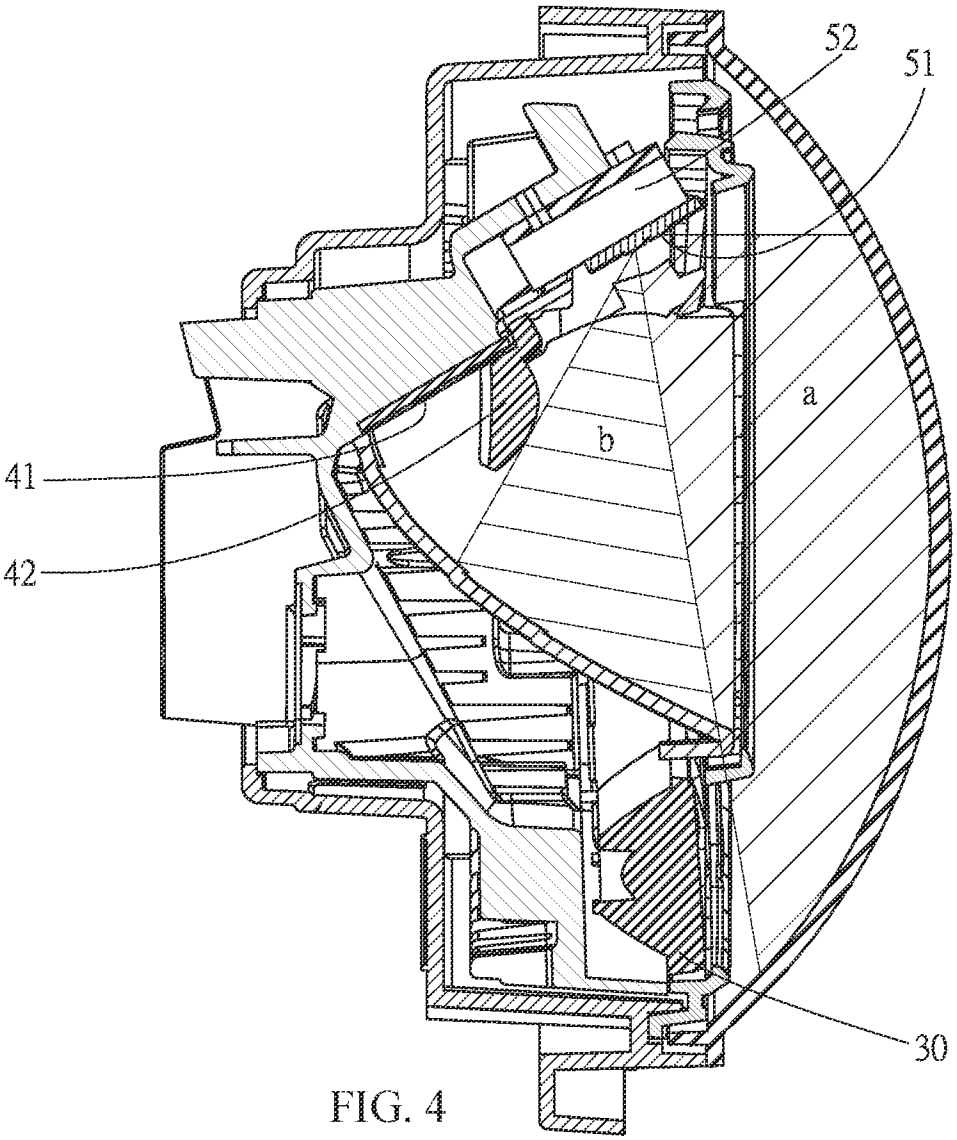
FIG. 4 is a schematic view of the irradiating area of the invisible light of the headlight.
Figure 5:
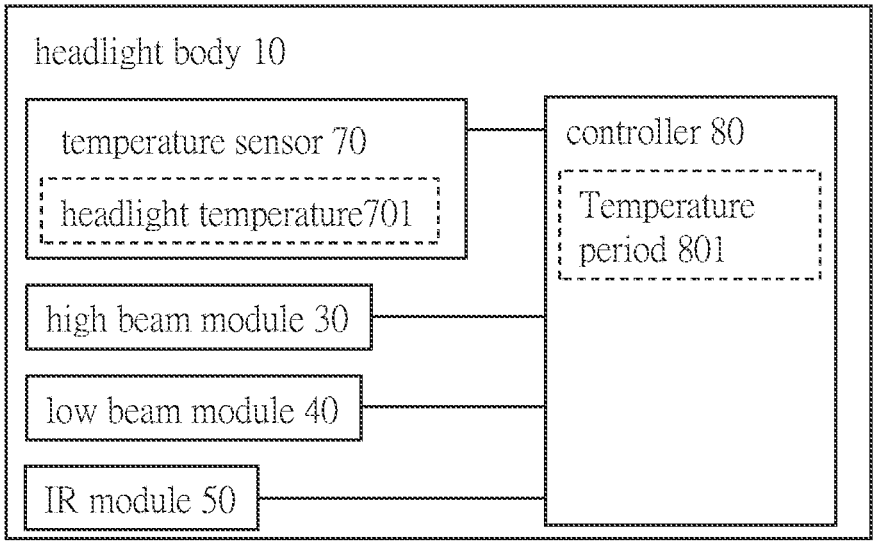
FIG. 5 is a systematic view of the headlight.

In the direction indicated in FIG. 3, the low beam module 40 is located between the IR module 50 and the high beam module 30, the edge of the reflector 43 of the low beam module 40 is connected to the periphery of the opening 21 of the frame 20. Thus, the frame 20 and the reflector 43 separates the high beam module 30 and the low beam module 40. The emitting ranges of the high beam module 30 and the low beam module 40 will not overlap. The IR module 50 is located above the low beam module 40, and the wide-angle LED lamp 51 is tilted and irradiates toward downward. The irradiating area (a+b) of the invisible light of the IR module 50 is roughly located in front of the visible light source 41 of the low beam module 40.

In the present embodiment, the irradiating area (a+b) of the wide-angle LED lamp 51 is limited by the opening 21 of the frame 20, thus defining an effective irradiating area (a) where directly irradiates on the lampshade 11. The irradiating area (a+b) of the wide-angle LED lamp 51 is located in front of the visible light source 41 of the low beam module 40 and the optical element 42. Therefore, the wide-angle LED lamp 51 will not directly irradiate on the visible light source 41 of the low beam module 40. The irradiating area (b) of the wide-angle LED lamp 51 will fall on the reflector 43, and the invisible light is reflected by the reflector 43 and then is directed toward the lampshade 11, and therefore will not directly irradiate on the high beam module 30, thus avoiding damage of the high beam module 30 and the low beam module 40 due to overheating.

What is claimed is:

1. A headlight, comprising:

a headlight body, having a housing and a lampshade, the lampshade having a light-absorbing and heating layer;

a temperature sensor, configured on the headlight body, to detect a headlight temperature;

an IR module, being a wide-angle LED lamp, positioned inside the headlight body, which directly irradiates toward the lampshade;

a low beam module, configured on the headlight body, emitting toward the lampshade, and an emitting direction of the low beam module crossing an irradiating direction of the IR module; and a controller, electrically connected to the IR module and the temperature sensor, which controls the IR module based on the headlight temperature;

wherein, said headlight body is installed with a high beam module;

wherein, said housing is installed with a frame located in front of the low beam module and the high beam module, the frame has at least two openings respectively corresponding to the emitting direction of the low beam module and the high beam module, the invisible light of the IR module irradiates toward the lampshade from the opening of the low beam module.

2. The headlight defined in claim 1, the IR module is controlled and activated together with the low beam module or the high beam module.

3. The headlight defined in claim 1, wherein said controller activates the IR module based on a temperature period.

4. The headlight is defined in claim 1, wherein, part of the invisible light beams of the IR module is directly toward the lampshade, and the other part of the invisible light beams is reflected by a reflector of the low beam module and then toward the lampshade.

5. The headlight defined in claim 1, wherein said light-absorbing and heating layer has a thickness of 10 μm~10 mm.

6. The headlight is defined in claim 1, wherein, the light-absorbing and heating layer of the said lampshade is distributed with light-absorbing and heating particles, and the size of the light-absorbing and heating particles is 1 nm~500 nm.

7. The headlight defined in claim 6, wherein said light-absorbing and heating layer contains 0.005 wt %~10 wt % of the light-absorbing and heating particles.

8. The headlight is defined in claim 1, wherein said light-absorbing and heating layer is distributed with light-absorbing and heating particles, and the light-absorbing and heating particles are selected from one or more tungsten oxide nanoparticles, tungsten bronze compound nanoparticles, indium tin oxide, antimony tin oxide, and lanthanum hexaboride.

9. The headlight defined in claim 1, wherein said lampshade is made of a light-absorbing and heating layer.

* * * * *